United States Patent [19]

Ogawa

[11] 4,144,669

[45] Mar. 20, 1979

[54] MULTIPLE FUNCTION WATER-GOING TOY

[75] Inventor: Iwakichi Ogawa, Kashiwa, Japan

[73] Assignee: Takara Co., Ltd., Tokyo, Japan

[21] Appl. No.: 806,141

[22] Filed: Jun. 13, 1977

[51] Int. Cl.[2] ..... A63H 33/06

[52] U.S. Cl. ..... 46/17; 46/96; 46/223

[58] Field of Search ..... 46/16, 17, 112, 116, 46/249, 250, 251, 1 R, 91, 93, 94, 95, 96, 201, 202, 23, 76 R, 223, 221; 273/156

[56] References Cited

U.S. PATENT DOCUMENTS

| | | | |
|---|---|---|---|
| 3,418,751 | 12/1968 | Mabuchi | 46/250 |
| 3,555,721 | 1/1971 | Furuoka | 46/95 |
| 3,986,293 | 10/1976 | Rieur | 46/16 |

FOREIGN PATENT DOCUMENTS

| | | | |
|---|---|---|---|
| 2446906 | 4/1976 | Fed. Rep. of Germany | 46/16 |

*Primary Examiner*—Russell R. Kinsey
*Assistant Examiner*—Mickey Yu
*Attorney, Agent, or Firm*—Jackson & Jones

[57] ABSTRACT

A toy aqua-plane includes a number of reconfigurable parts. One of the parts is a removable tank member which provides a second interesting puzzle toy. The puzzle toy may interact with a magnet included in another of the toy parts. The toy also includes an attachable watertight electric motor for propelling it through water.

15 Claims, 5 Drawing Figures

MULTIPLE FUNCTION WATER-GOING TOY

BACKGROUND OF THE INVENTION

1. Field of the Invention

The subject invention relates to toys and more particularly to a toy which is assembleable in a number of configurations and includes a number of subunits which may function as separate toys.

2. Brief Description of the Prior Art

To date the prior art has provided toys consisting of a number of standardized building block elements which may be assembled into various structures, such as the well-known erector set. The prior art has also provided kits which may be permanently assembled to form individual replicas of familiar objects such as airplanes and boats. However, the prior art has not provided a toy including a number of parts which are easily configurable into toys resembling vehicles such as an aqua-plane or a rocket-plane. Neither has such a toy been provided wherein subcombinations of the parts themselves comprise individual toys.

SUMMARY OF THE INVENTION

It is therefore an object of the invention to provide a unique and stimulating new toy.

It is another object of the invention to provide a toy which is easily assembled into a variety of configurations.

It is another object of the invention to provide such a toy wherein subcombinations of the toy parts are themselves capable of performing separate toy functions.

These and other objects and advantages of the invention are accomplished by providing a toy including a number of press-, snap- and slide-fittable parts, which may be configured into a number of toys. Some of these parts or subcombinations of parts may perform individual toy functions. According to one aspect of the invention motor means are provided for adapting one configuration of the preferred embodiment of the invention into a propeller-driven boat or aqua-plane. According to another aspect of the preferred embodiment of the invention, parts of the toy resembling a boat or rocket plane may perform the function of a maze or puzzle toy.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

DETAILED DESCRIPTION OF THE PREFERRED EMBODIMENT

The following description is provided to enable any person skilled in the toy industry to make and use the invention and it sets forth the best mode contemplated by the inventor of carrying out this invention. Various modifications, however, will remain readily apparent to those skilled in the above art, since the generic principles of the present invention are applied herein specifically to provide a relatively economical and easily manufactured toy.

Figure 1:
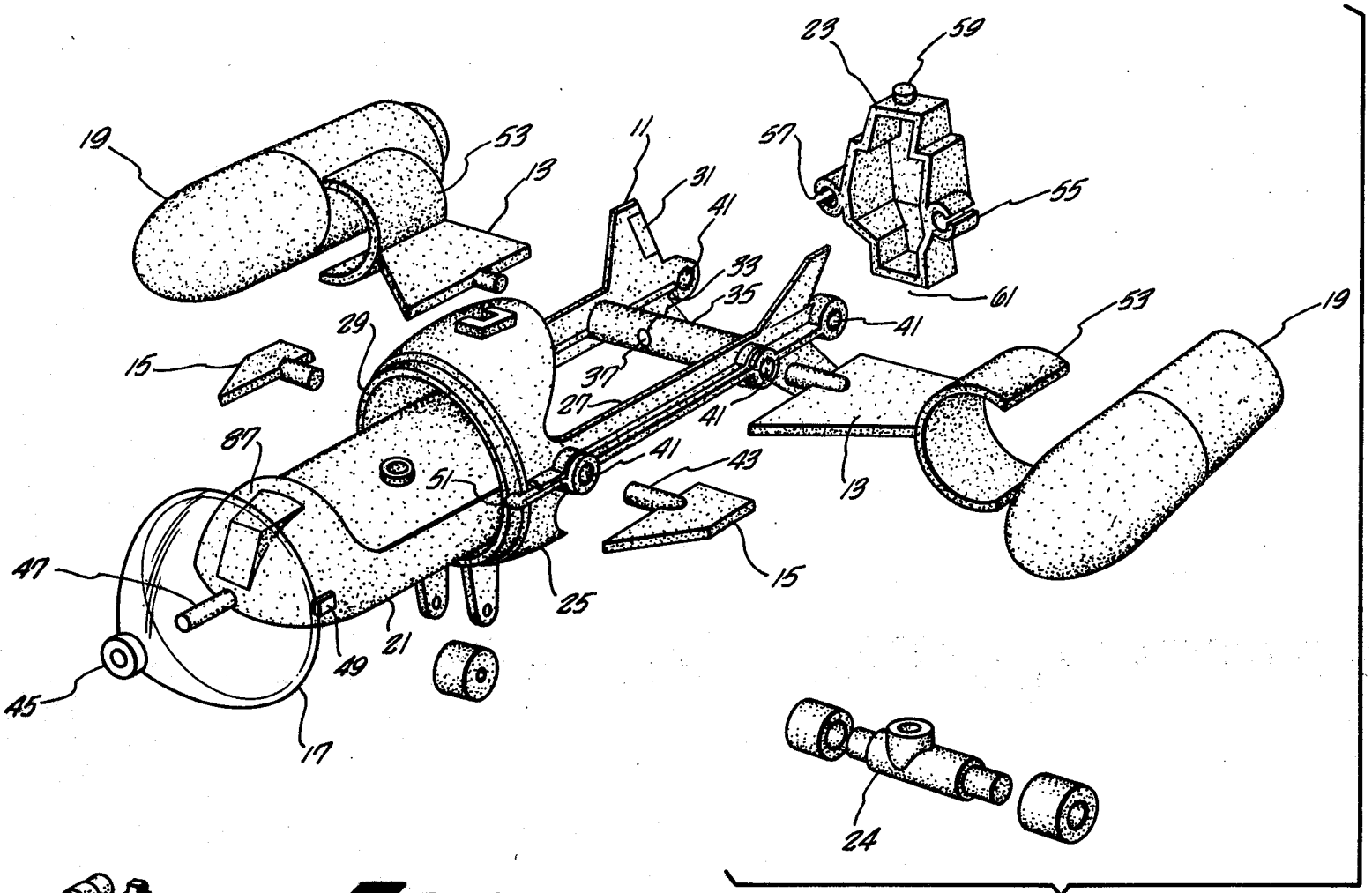
FIG. 1 is an exploded perspective view of the toy of the preferred embodiment of the invention.
Figure 5:
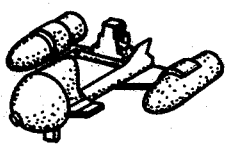
FIG. 5 is a perspective view of the preferred embodiment assembled as a boat or plane.

FIGS. 1 and 5 illustrate the configuration of the elements of the preferred embodiment of the invention as an aqua-plane, preferably for transporting an individual toy aquanaut. The aqua-plane consists of a basic frame member 11, rear stabilizers 13, front stabilizers 15, a cowling 17, propulsion pods 19 and a tank platform 21. A mounting unit 23 also slide-fits onto the frame 11 and may be used to attach a rear roller axle 24. The structure and operation of these elements will be described in further detail below.

The frame 11 is preferably constructed of plastic, as are the rest of the toy elements, and includes a hollow nose 25 and two side frame members 27 extending back from the nose 25. The nose 25 has a circular rim 29 formed thereon on which the cowling 17 fits. The rear portion of each side frame member 27 includes a slightly canted vertical stabilizer 31 and an interior side rib 33. The two side frame members 27 are joined just in front of the vertical stabilizer 31 by means of a cylindrical beam 35, which has an aperture 37 therein. A mounting pin (not shown) located at the rear of the tank 21 slideably fits into the aperture 37 to support the tank 21 at its rear. The frame 11 also includes a number of press-fit apertures 41 for mounting the horizontal stabilizers 13, 15 or other components having a press-fit plug such as shown at 43 thereon.

The cowling 17 is preferably constructed of clear plastic. It has a cylindrical aperture 45 therein for mounting a plug 47 located on the front of the tank 21. The cowling 17 also has two tabs 49 mounted at its perphery. These tabs 49 cooperate with hooks 51 mounted at the side of the frame nose 25.

To mount the cowling 17, the cowling 17 is placed on the rib 29 of the nose 25 with the tabs 49 turned away from the hooks 51 on the nose 25. The cowling 17 is then turned until the tabs 49 lock within the hooks 51. At the same time that the cowling 17 is mounted, the plug 47 at the front of the tank 21 may be inserted into the cowling mounting cyclinder 45, thereby enabling the tank 21 to be mounted simultaneously with the cowling 17. During this mounting, the tank 21 is slid through the nose opening 25 and the tab mounted at its rear portion is inserted into the aperture 37 on the cross beam 35 at the rear of the frame 11.

The stabilizer members 15, 13 are simply mounted by press-fitting into the apertures 41. The rear horizontal stabilizers 13 each have a flexible mounting receptacle 53 at their respective ends. A pod 19 may be snapped into the receptacle 53 to further enhance the air- or aqua-plane effect. The pods 19 are preferably hollow and watertight to provide buoyancy and stability when the plane is placed in water.

The mounting member 23 has projections 55 thereon, each of which bears a slot 57, enabling the member 23 to be slid onto the frame ribs 33, thereby mounting the member 23 between the vertical stabilizers 31. The member 23 also includes a press-fit aperture 59 and a press-fit plug 61. Because of the slots 57, the member 23 may be reversed in position by 180°, thereby facilitating flexibility in mounting of various press-fit parts to the member 23. In the orientation shown, the press-fit plug 61 is at the bottom for mounting to the landing gear 24.

Figure 2:
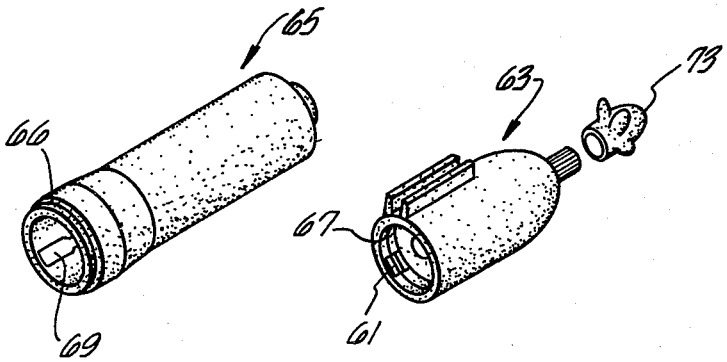
FIG. 2 is a perspective view of a motor assembly for propelling the toy of the preferred embodiment in water.

With the landing gear 24 in position the plane is equipped for ground travel. However, by utilizing the apparatus in FIGS. 2 and 3 and properly orienting the mounting member 23, the toy plane may be adapted for travel in water. FIG. 2 illustrates a watertight motor assembly and FIG. 3 illustrates the manner of attaching the assembly to the aqua-plane to provide locomotion.

The motor assembly of FIG. 2 includes a motor element 63 and a battery casing 65. The motor element 63 bears a sealing ring 67. The battery casing 65 bears a cooperating circular indentation 66 which permits the casing 65 to snap over the sealing ring 67. Then, by merely turning the battery casing 65, an electrical contact member 69 may be brought into contact with an electrical contact member 61 on the motor element 63 to cause energization of a propeller 73.

Figure 3:
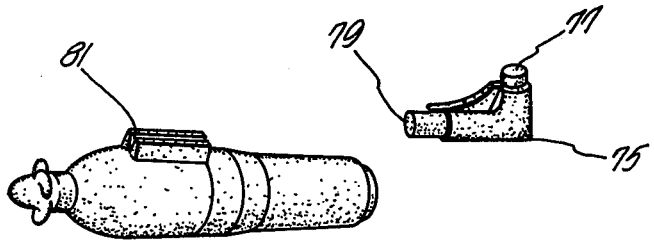
FIG. 3 is a perspective view of an assembled motor and cooperating attaching element.

FIG. 3 illustrates how the motor assembly is mounted to the aqua-plane of FIG. 1. The mounting member 23 (FIG. 1) is oriented oppositely to the orientation of FIG. 1 such that the press-fit aperture 59 is on the bottom. A right-angle mounting member 75 bearing two press-fit plugs 77 and 79 is then used to attach the motor and battery combination 63, 65 to the aqua-plane by inserting the plug 79 into a raised groove 81 on the motor assembly. When mounted, the motor extends beneath the plane and into a surrounding body of water. Of course, other orientations of the motor are possible, for example by simply altering the orientation of the mounting member 23. In general, numerous configurations of all of the various parts described above may be made, since the press-fit connections are preferably interchangeable.

Figure 4:
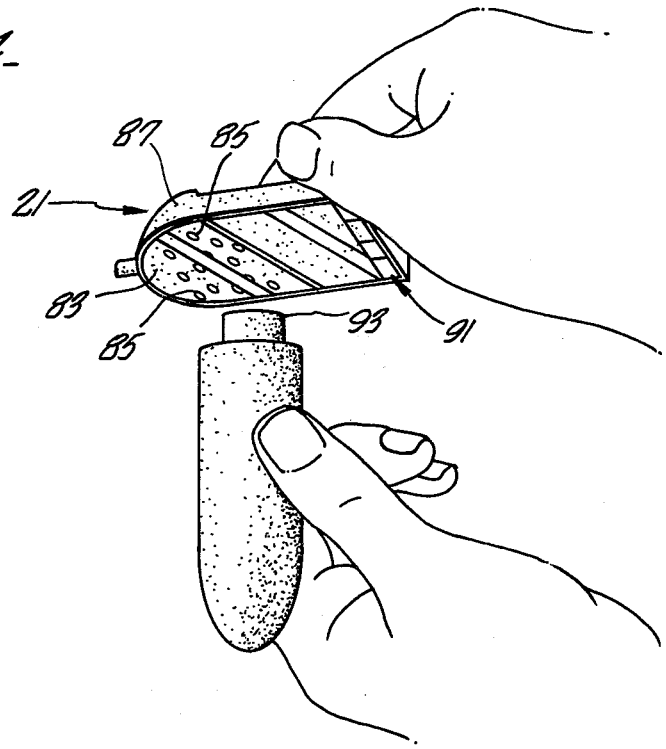
FIG. 4 is a perspective view illustrating the use of the tank element of the preferred embodiment as a puzzle toy.

One of the parts removable from the aqua-plane configuration is the tank element 21, which, according to the preferred embodiment, is adapted to perform a separate toy function. This adaptation is illustrated in FIG. 4.

The tank 21 includes a flat, clear-plastic cover 83, having a number of circular obstructing indentations or apertures 85 therein. One end 87 of the tank 21 forms a well wherein a steel ball may rest when the tank 21 is rotated 180° in position from that illustrated in FIG. 1. At the end of the tank 21 opposite the well 87, the tank bottom surface bears a number of slots 91, into which the steel ball may slide. A magnet 93 mounted in the rear of an engine pod 19 may then be used to manipulate the steel ball through a maze of apertures 85 and into the slots 91.

In utilizing the puzzle toy, the orientation of the tank 21 may be varied such that the manipulations are resisted by gravity. The different slots 91 may be accorded different values dependent on difficulty in order to keep score and provide additional challenge. A maze may also be provided in the tank bottom surface such that manual manipulations of the tank alone are required to guide the steel ball through the maze. Thus, many separate games are provided by the subparts of the toy plane of the preferred embodiment.

As is apparent, many modifications and alterations may be made in the subject preferred embodiment without departing from the scope and spirit of the invention. Therefore, it is to be understood that, within the scope of the appended claims, the invention may be practiced otherwise than as specifically described above.

What is claimed is:

1. A toy plane including a plurality of detachable parts, said parts comprising:
   a frame member;
   stabilizer means attachable to said frame member for configuring said frame member as a toy plane;
   a cowling member mountable on a front section of said frame member;
   a tank member mountable to said frame member and to said cowling member, and
   puzzle means in said tank member for utilizing said tank member as a separate puzzle toy, said puzzle means comprising a ball, a plurality of apertures and at least one slot, the ball being guidable through the apertures into the slot.

2. The toy of claim 1 wherein said parts are assembleable in the form of an aqua-plane and further including propulsion means attachable to said frame member for propelling said aqua-plane through water.

3. The toy of claim 2 further including a wheel assembly mountable to said frame member.

4. The toy of claim 3 further including a mounting member attachable to the frame member in at least two orientations, the mounting member capable of operatively mounting one of the propulsion means and the wheel assembly depending on its relative positioning with regards to the frame member.

5. A toy aquaplane comprising:
   a frame member, and
   means removably attachable to said frame member for adapting said frame member to perform a first toy function as a toy aquaplane, said means including a wheel assembly and buoyant means whereby the toy aquaplane is adapted for travel on a ground surface as well as on water, said means further including at least one element providing a second puzzle toy function.

6. The toy aquaplane of claim 5 further comprising a removably mountable motor element, the motor element being capable of propelling the toy aquaplane on a water surface.

7. The toy aquaplane of claim 5 further comprising a plurality of rear and front stabilizing elements mounted to the frame member, the stabilizing elements including substantially flat surfaces disposed parallel to a water surface when the toy aquaplane is placed into water, the buoyant means being mounted to the rear stabilizing elements.

8. The toy aquaplane of claim 7 further comprising a removably mountable motor element, the motor element being capable of propelling the toy aquaplane on a water surface.

9. The toy aquaplane of claim 7 wherein the element providing the puzzle toy function comprises a tank member incorporating a miniature ball and a plurality of apertures comprising a maze through which the ball may be guided.

10. The toy aquaplane of claim 9 wherein the tank member further incorporates a plurality of slots into which the ball may be guided through the maze.

11. A toy comprising:
   a plurality of parts configurable as a toy plane including a tank member and a bifurcated frame having stabilizing elements attached thereto, said tank member including a puzzle means having a portable member and obstructions and being removable from said frame so that said puzzle means may be separately utilized to move the portable member through the obstruction to score goals.

12. The toy of claim 11 wherein the portable member is a miniature ball; and the obstruction forms a maze through which said ball may be guided.

13. The toy of claim 12 wherein said ball is attractable by a magnetic field and said plurality of parts include a magnet for attracting said ball through said maze.

14. The toy of claim 13 further including water tight hollow pods mounted to the frame for stabilizing said toy plane in water.

15. A toy assembly configured to simulate an aquavehicle comprising;

a body member having a transparent side with a plurality of spaced obstructions and a plurality of slots;

a magnetizable member movably mounted in the body member and dimensioned to be capable of one of interfacing with the obstructions and translating between them to enter a slot;

at least a second member configured to complement the body member as a component of an aquavehicle and removable therefrom;

means for providing a magnetic field operatively connected to the second member; and motor means for propelling the assembled body member and second member through water, the second member further removable from the body member to exert a magnetic force field on the magnetizable member whereby an operator can attempt to manipulate the magnetizable member through the obstructions to position the magnetizable member in a slot.

* * * * *